US011213107B2

(12) United States Patent
Zhong et al.

(10) Patent No.: US 11,213,107 B2
(45) Date of Patent: Jan. 4, 2022

(54) CUSHION COMPACT CONTAINER

(71) Applicant: SHYA HSIN PACKAGING INDUSTRY(CHINA) CO., LTD., Kunshan (CN)

(72) Inventors: Hua Zhong, Kunshan (CN); Linglang Zhan, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 249 days.

(21) Appl. No.: 16/476,870

(22) PCT Filed: Mar. 29, 2017

(86) PCT No.: PCT/CN2017/078664
§ 371 (c)(1),
(2) Date: Jul. 10, 2019

(87) PCT Pub. No.: WO2018/129813
PCT Pub. Date: Jul. 19, 2018

(65) Prior Publication Data

US 2019/0350336 A1 Nov. 21, 2019

(30) Foreign Application Priority Data

Jan. 13, 2017 (CN) ..... 201710025884.X

(51) Int. Cl.
*A45D 33/24* (2006.01)
*A45D 33/00* (2006.01)

(52) U.S. Cl.
CPC ..... *A45D 33/24* (2013.01); *A45D 33/003* (2013.01); *A45D 33/008* (2013.01)

(58) Field of Classification Search
CPC .... A45D 33/24; A45D 33/003; A45D 33/008; A45D 33/006; A45D 33/025;
(Continued)

(56) References Cited

U.S. PATENT DOCUMENTS 7,832,564 B2 * 11/2010 Kim ..... A45D 33/008 206/581
10,384,842 B2 * 8/2019 Kim ..... A45D 33/24
2006/0151355 A1 * 7/2006 Oh ..... A45D 33/008 206/581

FOREIGN PATENT DOCUMENTS

CN 1819785 A 8/2006
CN 202536461 U 11/2012
(Continued)

*Primary Examiner* — David J Walczak
(74) *Attorney, Agent, or Firm* — Bayramoglu Law Offices LLC

(57) ABSTRACT

A cushion compact container includes an outer shell component and an inner case component placed inside the outer shell component. The inner case component includes an inner cover and an inner case. The inner case is provided with an opening at one side and is used for holding the cosmetic material. The inner cover is hinged to an opening side of the inner case, and is formed by integrated plastic molding. The inner cover is capable of opening and hermetically closing the opening side of the inner case. The inner case component inside the cushion compact container has a one-piece structure, which simplifies the manufacturing process and reduces the production cost.

9 Claims, 9 Drawing Sheets

(58) Field of Classification Search
CPC ..... A45D 33/10; A45D 33/16; A45D 33/22; A45D 33/26; A45D 33/34
USPC ..... 401/123–125, 19; 132/316, 317, 293, 132/300, 301, 304, 305
See application file for complete search history.

(56) References Cited

FOREIGN PATENT DOCUMENTS

| | | | |
|---|---|---|---|
| CN | 205513071 | U | 8/2016 |
| CN | 205513075 | U | 8/2016 |
| CN | 106136556 | A | 11/2016 |
| KR | 20150002400 | U | 6/2015 |

* cited by examiner

PRIOR ART

PRIOR ART

CUSHION COMPACT CONTAINER

CROSS REFERENCE TO RELATED APPLICATIONS

This application is the national phase entry of International Application PCT/CN2017/078664, filed on Mar. 29, 2017 which is based upon and claims priority to Chinese Patent Application No. 201710025884.X, filed on Jan. 13, 2017 the entire contents of which are incorporated herein by reference.

TECHNICAL FIELD

The present invention relates to the technical field of cosmetic containers, specifically provides a cushion compact container.

BACKGROUND

At present, the refill part of the widely used cushion compact container on the market mainly has a three-piece structure or a two-piece structure. Specifically, the three-piece structure mainly includes an inner cover component 30, an inner annular component 31, and an inner case component 32 (as shown in FIG. 1). The assembling process of the three-piece structure is as follows: filling the material into the inner case component 32 and putting a sponge component 33 into the inner case component 32 (or first putting the sponge component 33 into the inner case component, and then filling the material into the inner case component); fixing the inner annular component 31 on the open side of the inner case component 32 to hold the sponge component 33; and hinging the inner cover component 30 to the inner case component 32 to open and close the open side of the inner case component 32. The two-piece structure mainly includes an inner case component 40 and a middle engaging frame. The middle engaging frame includes a first middle engaging frame 41 and a second middle engaging frame 42 which are hinged to each other and integrally formed. The second middle engaging frame 42 is fitted with the inner case component 40 or the second middle engaging frame 42 is connected to the inner case component 40 by screws (as shown in FIG. 2). The assembling process of the two-piece structure is as follows: first filling the material into the inner case component 40, and then putting a sponge component 33 into the inner case component 40 (or first putting the sponge component 33 into the inner case component, and then filling the material into the inner case component), then fitting or screwing the inner case component with the middle engaging frame.

However, the structures of the above two refill parts have too many components, leading to a complicated assembling process and a high manufacturing cost.

It is, therefore, an objective of the present invention to provide a solution to address these issues.

SUMMARY

To overcome the above drawbacks, the present invention provides a cushion compact container, which has a simple structure, simplified manufacturing processes, reduced manufacturing cost, and good airtightness, and is capable of maintaining the quality of cosmetic material for a long time.

The present invention employs the following technical solutions in order to solve the above technical issues. A cushion compact container includes an outer shell component and an inner case component placed inside the outer shell component. The inner case component includes an inner cover and an inner case. The inner case is provided with an opening at one side and is used for holding a cosmetic material. The inner cover is hinged to an opening side of the inner case and is manufactured by integrated plastic injection molding. The inner cover is also capable of opening and hermetically closing the opening side of the inner case.

As a further improvement of the present invention, based on the state that the opening side of the inner case is hermetically closed with the inner cover, the inner cover includes an annular plate-shaped inner cover main body, an annular protruding edge extending from the inner cover main body in a direction away from the inner case around an edge of the inner cover main body, and an annular connecting edge radially extending outward from an outer sidewall of the protruding edge. The inner case includes an inner case main body having a hollow cylindrical shape and an opening at an upper end, an annular limit edge radially extending inward from an edge of the opening at the upper end of the inner case main body, and an annular folded edge radially extending outward from the edge of the opening at the upper end of the inner case main body and being bent upward.

As a further improvement of the present invention, one side of the connecting edge is hinged to one side of the folded edge, and the connecting edge and the folded edge are formed by integrated plastic injection molding. The inner cover main body is capable of opening and closing the opening at the upper end of the inner case main body.

As a further improvement of the present invention, an outer sidewall of the protruding edge is integrally formed with at least one first airtight edge ring extending toward the limit edge, and the at least one first airtight edge ring is coaxial with the inner cover main body. A side of the limit edge facing toward the protruding edge is integrally provided with at least one second airtight edge ring extending toward the protruding edge, and the second airtight edge ring is coaxial with the inner case main body.

When the inner cover main body closes the opening at the upper end of the inner case main body, the at least one first airtight edge ring is respectively engaged with the second airtight edge ring and the folded edge to form multiple engaging surfaces. Besides, at least one of the engaging surfaces is tightly wrapped with a sealing layer made of a soft plastic material.

As a further improvement of the present invention, two first airtight edge rings and one second airtight edge ring are provided. The two first airtight edge rings collectively form a first groove where the second airtight edge ring is inserted. The second airtight edge ring and the folded edge collectively form a second groove where the first airtight edge ring at an outer side is inserted. Moreover, at least one of circumferential sidewalls of the two first airtight edge rings, a circumferential sidewall of the second airtight edge ring, an inner circumferential sidewall of the first groove, and an inner circumferential sidewall of the second groove is tightly wrapped with the sealing layer.

As a further improvement of the present invention, one first airtight edge ring and one second airtight edge ring are provided.

The second airtight edge ring and the folded edge collectively form a second groove where the first airtight edge ring is inserted. One of an inner circumferential sidewall of the second groove and a circumferential sidewall of the first airtight edge ring is tightly wrapped with the sealing layer.

As a further improvement of the present invention, the sealing layer is integrally formed with the engaging surfaces.

As a further improvement of the present invention, the outer shell component includes an outer shell body and an outer shell cover. An accommodating space is formed in the outer shell body. The accommodating space penetrates through an upper end and a lower end of the outer shell body to form an upper opening and a lower opening of the accommodating space. The outer shell cover is hinged to the outer shell body and is capable of opening and closing the upper opening of the accommodating space.

The inner cover and the inner case can be coaxially embedded in the accommodating space, and the inner case is further connected to the upper opening of the accommodating space in snap-fit manner.

As a further improvement of the present invention, the outer shell body includes a base part having a hollow cylinder shape and openings at the upper end and the lower end, and an annular convex edge radially extending inward from an edge of the opening at the lower end of the base part. The base part and the convex edge collectively form the accommodating space.

One side of the outer shell cover is hinged to an outer wall of one side of the base part, and the other side of the outer shell cover is further provided with a first hook. An outer wall of the other side of the base part is further integrally provided with a second hook matched with the first hook, and the first hook can be engaged with or disengaged from the second hook.

As a further improvement of the present invention, a structure to realize the engagement between the inner case and the upper opening of the accommodating space is as follows. A position on an inner sidewall of the base part and near the upper opening of the base part is provided with a recess recessed inward from the inner sidewall of the base part. A side surface of the folded edge facing away from the connecting edge is integrally provided with a connecting edge ring. An outer sidewall of the connecting edge ring is integrally provided with a convex rib radially extending outward. Moreover, a side of the folded edge facing away from the inner case main body is flexibly mounted on an edge of the upper opening of the base part. The convex rib is freely inserted into the recess.

As a further improvement of the present invention, a position on the outer shell cover and near one side of the outer shell cover is fixedly provided with an elastic component. The elastic component has an elasticity and resiliently presses against an outer wall of the base part.

Additionally, based on the state that the upper opening of the accommodating space is closed by the outer shell cover, an inner side surface of the outer shell cover facing toward the accommodating space is further fixed with a mirror plate.

The present invention has the following advantages: ① the inner case component of the cushion compact container has an integrated structure, simplifying the manufacturing process and reducing the manufacturing cost; ② at least one of the engaging surfaces between the first airtight edge ring, the second airtight edge ring, and the folded edge is tightly wrapped with a sealing layer made of a soft plastic material, greatly enhancing the hermetic sealing effect of the inner cover and the inner case, so as to ensure the quality of cosmetic material in the inner case for a long time.

Figure 1:
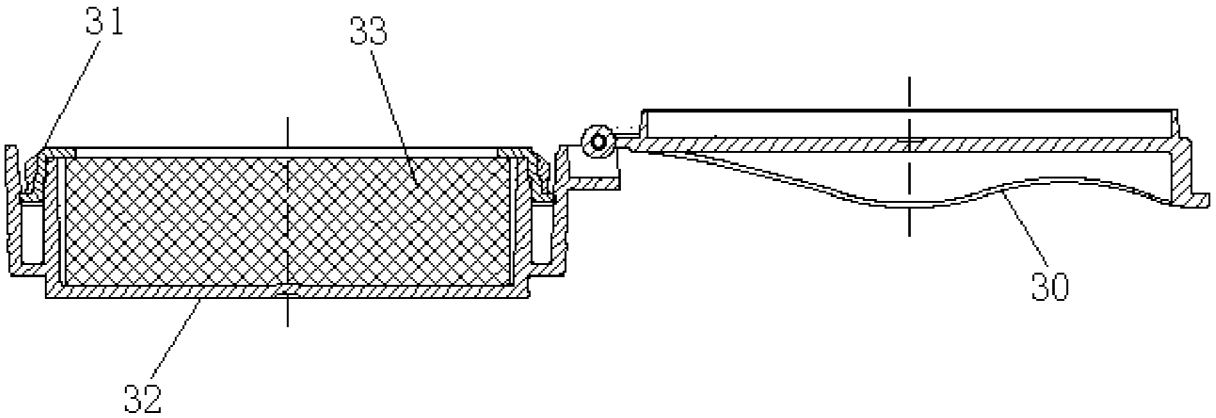
FIG. 1 is a structural diagram showing a common three-piece refill component of the commonly used cushion compact container.
Figure 2:
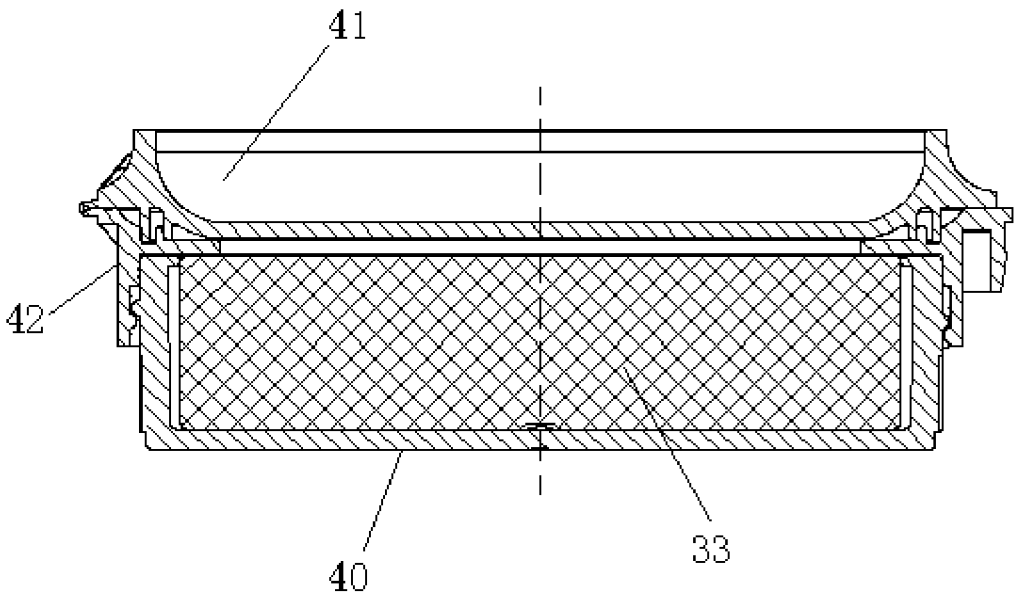
FIG. 2 is a structural diagram showing a common two-piece refill component of the commonly used cushion compact container.

The reference designators in the drawings are described below:

| | |
|---|---|
| 1--outer shell component | 10--outer shell body |
| 100--base part | 101--convex edge |
| 102--recess | 11--outer shell cover |
| 12--elastic component | 13--mirror plate |
| 2--inner case component | 20--inner cover |
| 200--inner cover main body | 201--protruding edge |
| 202--connecting edge | 203--first airtight edge ring |
| 21--inner case | 210--inner case main body |
| 211--limit edge | 212--folded edge |
| 213--second airtight edge ring | 214--connecting edge ring |
| 215--convex rib | 22--sealing layer |
| 30--inner cover component | 31--inner ring component |
| 32--inner case component | 33—sponge |
| 40--inner case body | 41--first middle engaging frame |
| 42--second middle engaging frame | |

DETAILED DESCRIPTION OF THE EMBODIMENTS

The preferred embodiments of the present invention will be described in detail hereinafter with reference to the drawings.

EMBODIMENT

Figure 3:
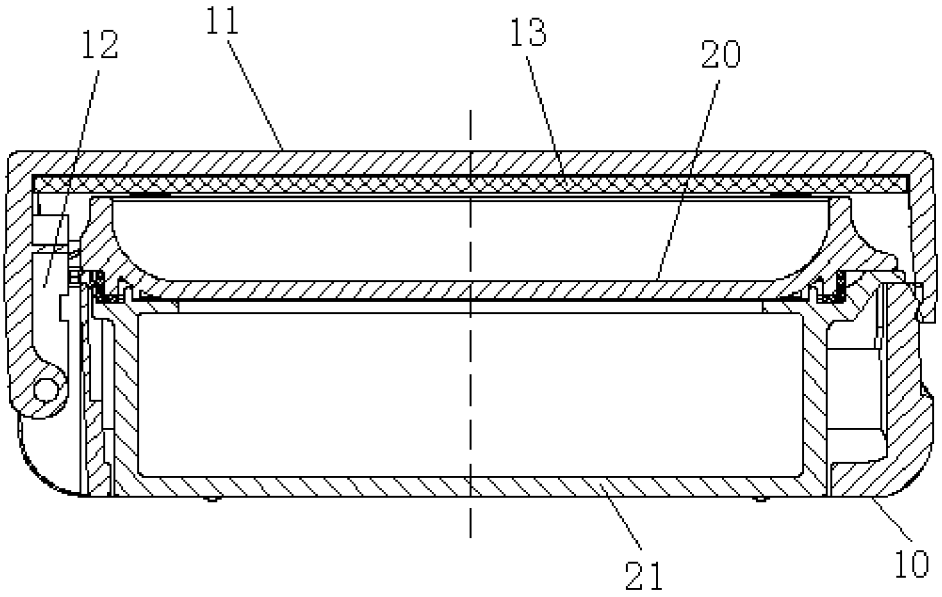
FIG. 3 is a sectional view showing a structure of a cushion compact container of the present invention in a closed state.

With reference to FIG. 3, FIG. 3 is a sectional view showing a structure of a cushion compact container of the present invention in a closed state. The cushion compact container includes the outer shell component 1 and the inner case component 2 placed inside the outer shell component 1. The inner case component 2 includes the inner cover 20 and the inner case 21. The inner case 21 is provided with an opening at one side and is used for holding a cosmetic material. The inner cover 20 is hinged to the open side of the inner case 21 and is manufactured by integrated plastic injection molding. The inner cover 20 is also capable of opening and hermetically closing the open side of the inner case 21.

The present embodiment is based on the state that the open side of the inner case is hermetically closed with the inner cover 20. The inner cover 20 includes an annular plate-shaped inner cover main body 200, the annular protruding edge 201 extending from the inner cover main body 200 in a direction away from the inner case 21 around the edge of the inner cover main body 200 (i.e. extends upward), and the annular connecting edge 202 radially extending outward from an outer sidewall of the protruding edge 201. The inner case 21 includes an inner case main body 210 which has a hollow cylindrical shape and an opening at an upper end thereof (the empty space inside the inner case main body is used to hold the cosmetic material), an annular limit edge 211 radially extending inward from an edge of the opening at the upper end of the inner case main body 210 (for holding the sponge), and an annular folded edge 212 radially extending outward from the edge of the opening at the upper end of the inner case main body 210 and being bent upward.

Figure 5:
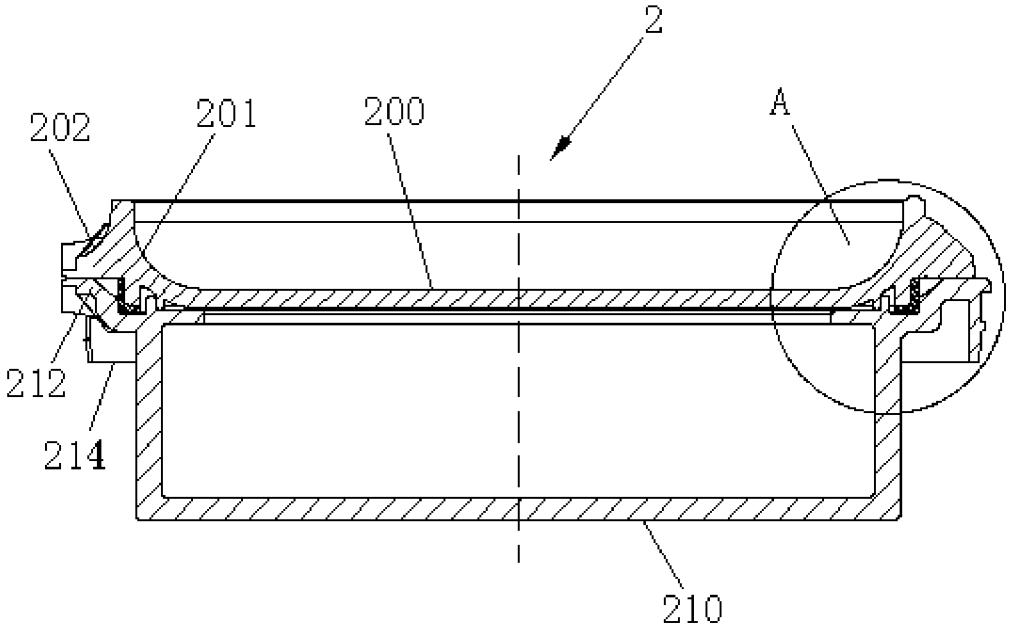
FIG. 5 is a sectional view showing a structure of an inner case component in a closed state according to the present invention.

Further, one side of the connecting edge 202 is hinged to one side of the folded edge 212, and the connecting edge 202 and the folded edge 212 are formed by integrated plastic injection molding. The inner cover main body 200 is capable of opening and closing the opening at the upper end of the inner case main body 210 (as shown in FIG. 5).

Preferably, an outer sidewall of the protruding edge 201 is integrally formed with at least one first airtight edge ring 203 extending toward the limit edge 211 (i.e. extending downward), and the at least one first airtight edge ring 203 is coaxial with the inner cover main body 200. A side of the limit edge 211 facing toward the protruding edge 201 is integrally provided with at least one second airtight edge ring 213 extending toward the protruding edge (i.e. extending upward), and the second airtight edge ring 213 is coaxial with the inner case main body 210.

Figure 6:
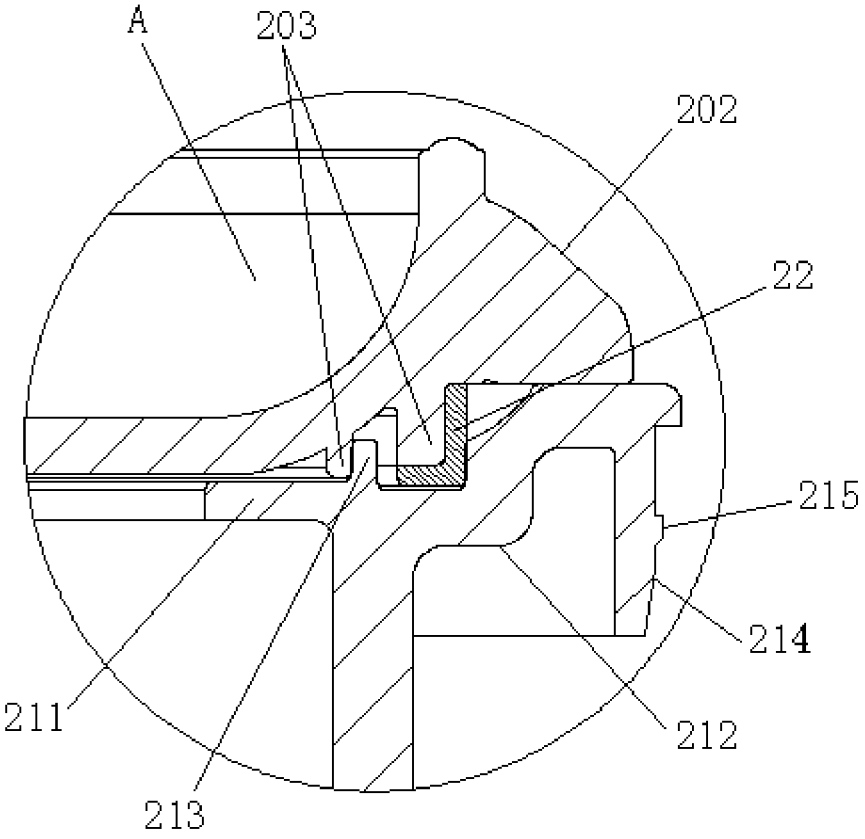
FIG. 6 is an enlarged view of portion A shown in FIG. 5.
Figure 7:
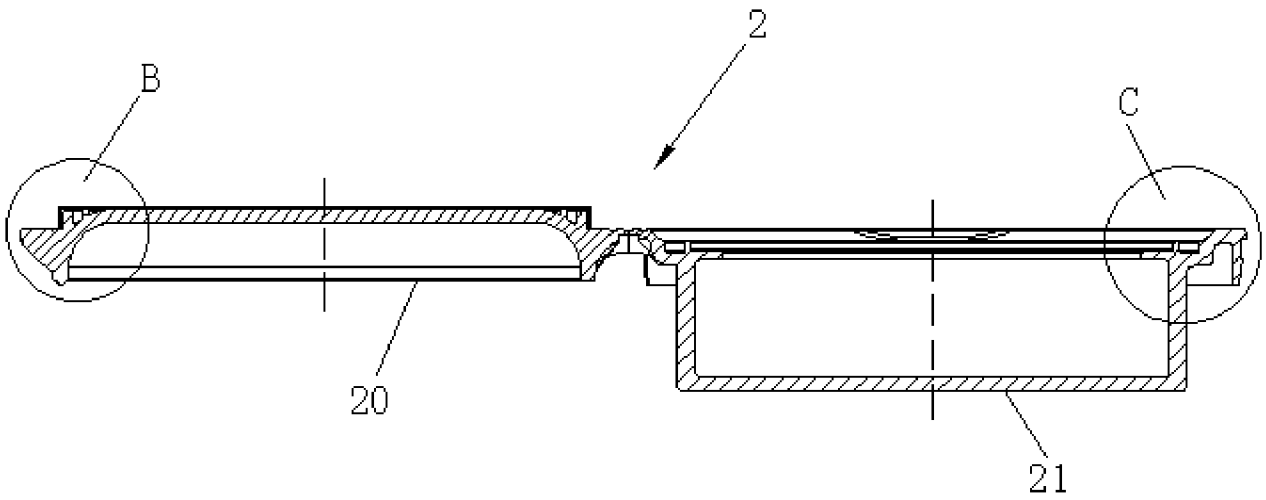
FIG. 7 is a sectional diagram showing a structure of the inner case component in an open state according to the present invention.
Figure 8:
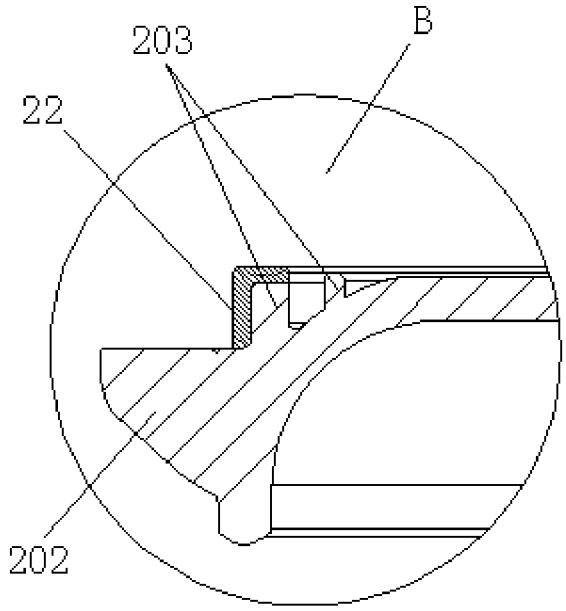
FIG. 8 is an enlarged view of portion B shown in FIG. 7.

When the inner cover main body 200 closes the opening at the upper end of the inner case main body 210, the at least one first airtight edge ring 203 is respectively engaged with the second airtight edge ring 213 and the folded edge 212 to form multiple engaging surfaces. Besides, at least one of the engaging surfaces is tightly wrapped with the sealing layer 22 made of a soft plastic material (as shown in FIG. 6 and FIG. 8). Preferably, the sealing layer 22 and the engaging surface are integrally formed. By tightly wrapping at least one of the engaging surfaces between the first airtight edge ring, the second airtight edge ring, and the folded edge with the sealing layer made of soft plastic material, the sealing and closing effect of the inner cover and inner case is greatly improved, effectively ensuring the quality of the cosmetic material inside the inner case.

More preferably, as needed, two first airtight edge rings 203 and one second airtight edge ring 213 may be provided. The two first airtight edge rings 203 collectively form a first groove where the second airtight edge ring 213 is inserted. The second airtight edge ring 213 and the folded edge 212 collectively form a second groove where the first airtight edge ring 203 at the outer side is inserted. Moreover, at least one of the circumferential sidewalls of the two first airtight edge rings 203, the circumferential sidewall of the second airtight edge ring 213, the inner circumferential sidewall of the first groove, and the inner circumferential sidewall of the second groove is tightly wrapped with the sealing layer 22.

Alternatively, as needed, one first airtight edge ring 203 and one second airtight edge ring 213 are provided. The second airtight edge ring 213 and the folded edge 212 collectively form the second groove where the first airtight edge ring 203 is inserted. One of the inner circumferential sidewall of the second groove and the circumferential sidewall of the first airtight edge ring 203 is tightly wrapped with the sealing layer 22.

In the present embodiment, the outer shell component 1 includes the outer shell body 10 and the outer shell cover 11. An accommodating space is formed on the outer shell body 10. The accommodating space penetrates through the upper end and the lower end of the outer shell body 10 to form an upper opening and a lower opening of the accommodating space. The outer shell cover 11 is hinged to the outer shell body 10 and is capable of opening and closing the upper opening of the accommodating space.

The inner cover 20 and the inner case 21 can be coaxially embedded in the accommodating space, and the inner case 21 is further connected to the upper opening of the accommodating space in snap-fit manner.

Preferably, the outer shell body 10 includes the base part 100 having a hollow cylindrical shape and openings at the upper end and the lower end thereof, and the annular convex edge 101 radially extending inward from the edge of the opening at the lower end of the base part 100. The base part 100 and the convex edge 101 collectively form the accommodating space. One side of the outer shell cover 11 is hinged to the outer wall on one side of the base part 100, and the other side of the outer shell cover 11 is further provided with a first hook. The outer wall of the other side of the base part 100 is further integrally provided with a second hook matched with the first hook, and the first hook can be engaged with or disengaged from the second hook (as shown in FIG. 4).

Figure 9:
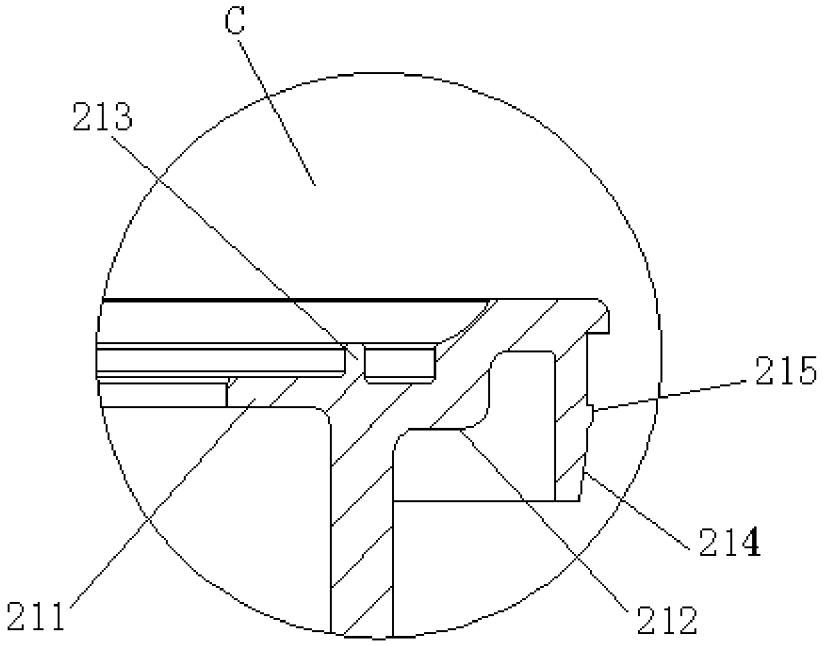
FIG. 9 is an enlarged view of portion C shown in FIG. 7.
Figure 10:
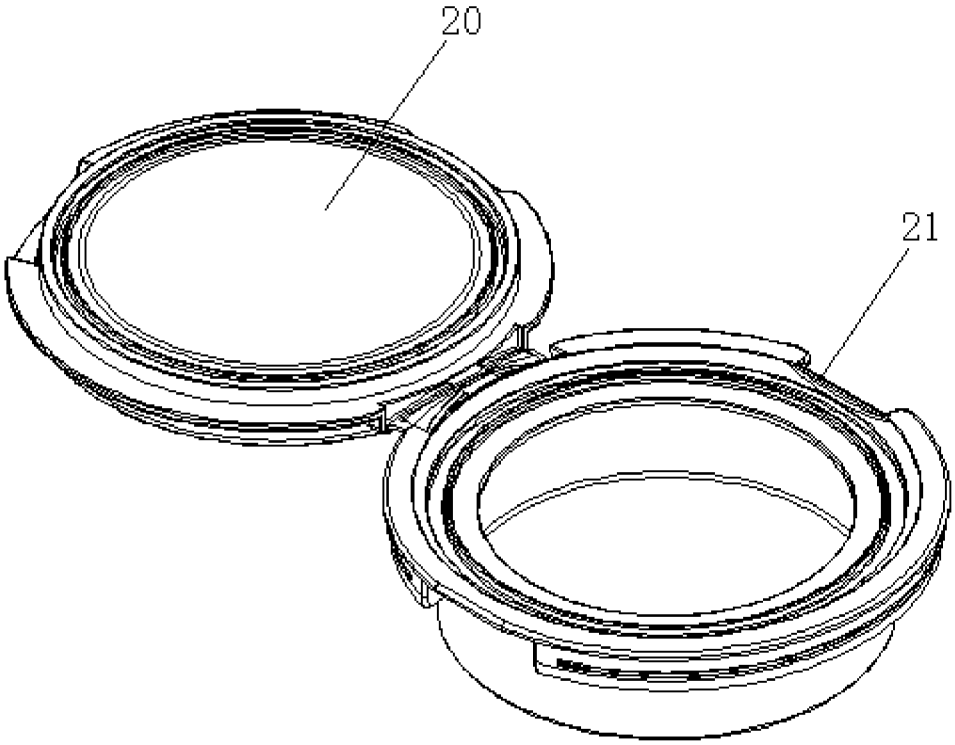
FIG. 10 is a perspective view showing the structure of the inner case component in an open state according to the present invention.

More preferably, the structure to realize the engagement between the inner case 21 and the upper opening of the accommodating space is as follows. A position on the inner sidewall of the base part 100 and near the upper opening of the base part is provided with the recess 102 recessed inward from the inner sidewall of the base part 100. A side surface of the folded edge 212 facing away from the connecting edge 202 is integrally provided with the connecting edge ring 214. An outer sidewall of the connecting edge ring 214 is integrally provided with the convex rib 215 radially extending outward. Moreover, a side of the folded edge 212 facing away from the inner case main body 210 can be flexibly mounted on the edge of the upper opening of the base part 100. The convex rib 215 can be freely inserted into the recess 102 (as shown in FIGS. 4, 6, 9).

More preferably, a position on the outer shell cover 11 and near one side of the outer shell cover 11 is fixedly provided with the elastic component 12. The elastic component 12 has elasticity and resiliently presses against the outer wall of the base part 100 under the action of the outer shell cover. Namely, the elastic component enables the outer shell cover to be opened resiliently.

Figure 4:
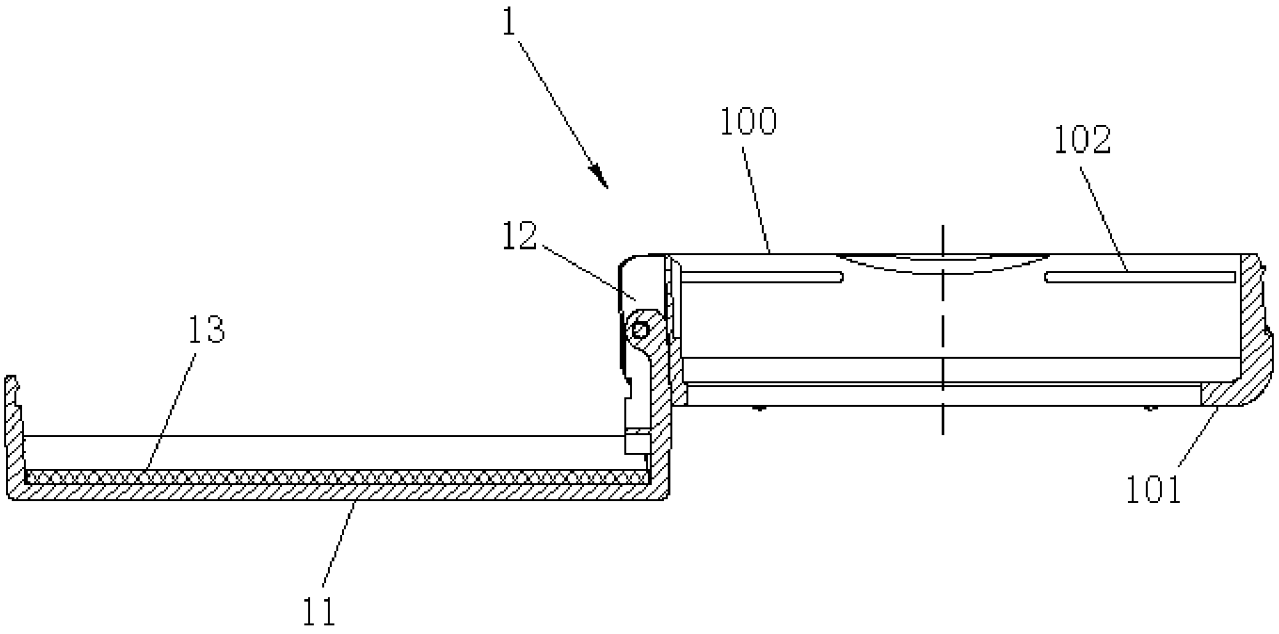
FIG. 4 is a sectional view showing a structure of an outer shell component in an open state according to the present invention.

Additionally, based on the state that the upper opening of the accommodating space is closed by the outer shell cover 11, the inner side surface of the outer shell cover 11 facing toward the accommodating space is further fixed with the mirror plate 13 (as shown in FIG. 4).

Besides, the method for using the cushion compact container of the present invention includes: first opening the outer shell cover 11, then taking the inner case component 2 out of the outer shell body 10, and finally opening the inner cover 20, and the cushion compact container is ready for use.

In conclusion, compared with the prior art, the cushion compact container of the present invention has the following advantages: ① the inner case component has an integrated structure, simplifying the manufacturing process and reducing the manufacturing cost; ② at least one of the engaging surfaces between the first airtight edge ring, the second airtight edge ring, and the folded edge is tightly wrapped with a sealing layer made of a soft plastic material, greatly enhancing the hermetic sealing effect of the inner cover and the inner case, so as to ensure the quality of cosmetic material in the inner case for a long time.

The embodiments are merely intended to illustrate the effect of the present invention rather than limit the scope of the present invention. It should be noted that, for those of ordinary skill in the art, various changes and modifications may be made without departing from the technical principles of the present invention, and these modifications and variations should be considered as falling within the scope of the present invention.

What is claimed is:

1. A cushion compact container comprising an outer shell component and an inner case component placed inside the outer shell component, wherein the inner case component comprises an inner cover and an inner case, the inner case is provided with an opening at one side and is used for holding a cosmetic material, the inner cover is hinged to an opening side of the inner case and is manufactured by integrated plastic injection molding, and the inner cover is capable of opening and hermetically closing the opening side of the inner case, wherein the inner cover comprises an annular plate-shaped inner cover main body, an annular protruding edge extending from an edge of the inner cover main body in a direction away from the inner case, and an annular connecting edge radially extending outward from an outer sidewall of the annular protruding edge; wherein the inner case comprises an inner case main body having a hollow cylindrical shape and the opening at an upper end; an annular limit edge radially extends inward from an edge of the opening at the upper end of the inner case main body, and an annular folded edge radially extends outward from the edge of the opening at the upper end of the inner case main body and is bent upward; and wherein, one side of the annular connecting edge is hinged to a side of the annular folded edge, and the annular connecting edge and the folded edge are formed by integrated plastic injection molding, and the inner cover main body is capable of opening and closing the opening at the upper end of the inner case main body.

2. The cushion compact container according to claim 1, wherein the outer sidewall of the annular protruding edge is integrally formed with at least one first airtight edge ring extending toward the annular limit edge, and the at least one first airtight edge ring is coaxial with the inner cover main body; a side of the annular limit edge facing toward the annular protruding edge is integrally provided with at least one second airtight edge ring extending toward the annular protruding edge, and the at least one second airtight edge ring is coaxial with the inner case main body; and when the inner cover main body closes the opening at the upper end of the inner case main body, the at least one first airtight edge ring is respectively engaged with the at least second airtight edge ring and the annular folded edge to form multiple engaging surfaces; and at least one of the multiple engaging surfaces is tightly wrapped with a sealing layer made of a soft plastic material.

3. The cushion compact container according to claim 2, wherein two first airtight edge rings and one second airtight edge ring are provided, the two first airtight edge rings collectively form a first groove, and the second airtight edge ring is inserted in the first groove; the second airtight edge ring and the annular folded edge collectively form a second groove, and one of the two first airtight edge rings at an outer side is inserted in the second groove, at least one of circumferential sidewalk of the two first airtight edge rings, a circumferential sidewall of the second airtight edge ring, an inner circumferential sidewall of the first groove, and an inner circumferential sidewall of the second groove is tightly wrapped with the sealing layer.

4. The cushion compact container according to claim 2, wherein one first airtight edge ring and one second airtight edge ring are provided;

the second airtight edge ring and the annular folded edge collectively form a second groove, and the first airtight edge ring is inserted in the second groove, and one of an inner circumferential sidewall of the second groove and a circumferential sidewall of the first airtight edge ring is tightly, wrapped with the sealing layer.

5. The cushion compact container according to claim 2, wherein the sealing layer and the engaging surfaces are integrally formed.

6. The cushion compact container according to claim 1, wherein the outer shell component comprises an outer shell body and an outer shell cover, an accommodating space is formed in the outer shell body; the accommodating space penetrates through an upper end and a lower end of the outer shell body to form an upper opening and a lower opening of the accommodating space, the outer shell cover is hinged to the outer shell body and is capable of opening and closing the upper opening of the accommodating space; and the inner cover and the inner case are coaxially embedded in the accommodating space, and the inner case is further connected to the upper opening of the accommodating space in a snap-fit manner.

7. The cushion compact container according to claim 6, wherein the outer shell body comprises a base part having a hollow cylindrical shape and the upper opening and the lower opening at an upper end and a lower end, and an annular convex edge radially extending inward from an edge of the lower opening at the lower end of the base part, the base part and the annular convex edge collectively form the accommodating space; and a first side of the outer shell cover is hinged to an outer wall of a first side of the base part, and a second side of the outer shell cover is further provided with a first hook, an outer wall of the second side of the base part is further integrally provided with a second hook matched with the first hook, and the first hook is engaged with or disengaged from the second hook.

8. The cushion compact container according to claim 7, wherein a position on an inner sidewall of the base part and near the upper opening of the base part is provided with a recess recessed inward from the inner sidewall of the base part, a side surface of the annular folded edge facing away from the annular connecting edge is integrally provided with a connecting edge ring, an outer sidewall of the connecting edge ring is integrally provided with a convex rib radially extending outward;

wherein, a side of the annular folded edge facing away from the inner case main body is flexibly mounted on an edge of the upper opening of the base part, and the convex rib is freely inserted into the recess.

9. The cushion compact container according to claim 7, wherein a position on the outer shell cover and near one side of the outer shell cover is fixedly provided with an elastic component; the elastic component has an elasticity and resiliently presses against an outer wall of the base part; and an inner side surface of the outer shell cover facing toward the accommodating space is further fixed with a mirror plate.

* * * * *